US007972222B2

(12) United States Patent
Llewellyn et al.

(10) Patent No.: US 7,972,222 B2
(45) Date of Patent: Jul. 5, 2011

(54) IRON GOLF CLUB HEADS AND GOLF CLUB SETS WITH VARIABLE WEIGHT DISTRIBUTION

(75) Inventors: David Llewellyn, Duluth, GA (US); Tetsuya Kanayama, Osaka (JP); Kazuhiro Doi, Gifu-pref (JP)

(73) Assignee: Mizuno USA, Inc., Norcross, GA (US)

( * ) Notice: Subject to any disclaimer, the term of this patent is extended or adjusted under 35 U.S.C. 154(b) by 0 days.

(21) Appl. No.: 12/492,701

(22) Filed: Jun. 26, 2009

(65) Prior Publication Data

US 2010/0167834 A1 Jul. 1, 2010

Related U.S. Application Data

(63) Continuation of application No. 29/330,015, filed on Dec. 25, 2008, now Pat. No. Des. 603,923.

(51) Int. Cl.
*A63B 53/04* (2006.01)

(52) U.S. Cl. ..... 473/291; 473/350

(58) Field of Classification Search ..... 473/290–291, 473/350

See application file for complete search history.

(56) References Cited

U.S. PATENT DOCUMENTS

| | | | | |
|---|---|---|---|---|
| 6,921,344 | B2 * | 7/2005 | Gilbert et al. | 473/334 |
| 2003/0203763 | A1 * | 10/2003 | Best | 473/290 |
| 2005/0085312 | A1 * | 4/2005 | Nagai et al. | 473/291 |
| 2005/0096151 | A1 * | 5/2005 | Hou et al. | 473/335 |
| 2006/0030425 | A1 * | 2/2006 | Sukman | 473/345 |
| 2006/0234805 | A1 * | 10/2006 | Gilbert et al. | 473/290 |
| 2006/0234809 | A1 * | 10/2006 | Gilbert et al. | 473/291 |
| 2006/0258480 | A1 * | 11/2006 | Hou et al. | 473/332 |
| 2008/0058113 | A1 * | 3/2008 | Nicolette et al. | 473/290 |
| 2008/0058119 | A1 * | 3/2008 | Soracco et al. | 473/350 |
| 2009/0042664 | A1 * | 2/2009 | Stites et al. | 473/291 |
| 2009/0062032 | A1 * | 3/2009 | Boyd et al. | 473/338 |

* cited by examiner

*Primary Examiner* — Stephen L. Blau

(74) *Attorney, Agent, or Firm* — Troutman Sanders LLP; James E. Schutz; Jihan A. R. Jenkins

(57) ABSTRACT

Described herein are iron golf club heads and sets of iron golf clubs that have variable weight distribution. Each iron golf club head has a cavity and a groove with a raised portion disposed therein. The groove and the raised portion can deepen the center of mass depth and lengthen the effective face length of the iron golf club. The width of the groove may vary between each golf club in a set of iron golf clubs, such that the width of the groove of the long irons is greater that the width of the groove of the middle irons, and the width of the groove of the middle irons is greater than the width of the optional groove of the short irons. Other aspects, embodiments, and features are also claimed and discussed.

24 Claims, 4 Drawing Sheets

IRON GOLF CLUB HEADS AND GOLF CLUB SETS WITH VARIABLE WEIGHT DISTRIBUTION

CROSS-REFERENCE TO RELATED APPLICATIONS

This application is a continuation of and claims priority to U.S. Design patent application Ser. No. 29/330,015 filed on 25 Dec. 2008, which is incorporated herein by reference in its entirety as if fully set forth below.

TECHNICAL FIELD

The various embodiments of the present invention relate generally to iron golf club heads and, more particularly, to cavity-back iron golf club heads with variable width grooves, which include a raised section disposed within the grooves, that increases the center of gravity depth of the iron golf club head and increases the effective hitting surface.

BACKGROUND

Perimeter weighted iron golf club heads have become increasingly popular with golfers since they were first introduced in the 1980's. The cavity-back iron golf club head moved most of the weight that was located behind the face of the golf club out to the perimeter of the golf club, which enlarged the "sweet spot" of the golf club and made the golf club more forgiving on "off-center" hits as compared to the traditional irons. Also, by moving the weight towards the perimeter, the thickness of the faces of the cavity back iron golf clubs became uniform and relatively thin. This resulted in a significant increase in the amount of carry in the case of off-center hits (i.e., where the golf ball is struck at a location other than the sweet spot) especially toward the toe area of the face. Unfortunately, this also resulted in a reduction in solid feel.

Another problem with traditional cavity-back iron golf clubs is that little of the weight is offset from the face portion. As a result, the center of gravity (COG) depth was not very great. One attempt to overcome this problem was to "offset" the clubface from the shaft portion, thereby placing the majority of the weight behind the shaft axis. Although the offset of the golf club increased the COG depth, it made the club unattractive to the golfer, especially those golfers who preferred the look of the traditional irons.

Yet another problem with traditional cavity-back iron golf clubs is that they have been produced by investment cast methods, since their unusual shape (i.e., perimeter weighting and offset) made them difficult and expensive to produce through forging. Unfortunately, making iron golf club heads using investment cast methods tends to makes the clubs have a distinctive "harder feel" than the traditional "soft feel" of forged carbon steel irons, which most players traditionally favor.

Therefore, there is a continuing need for an iron golf club head that has the improved playability properties of cavity-back golf clubs, while retaining the look and characteristics of traditional forged iron golf clubs. In particular, there is a need for a forged iron golf club head that provides an increased center of gravity depth, and a large sweet spot. Examples of such golf club heads are disclosed in commonly-assigned U.S. Pat. No. 7,022,028, which is incorporated herein in its entirety as if fully set forth below. Other examples are provided by the various embodiments of the present invention.

BRIEF SUMMARY OF EXEMPLARY EMBODIMENTS

The various embodiments of the present invention meet the needs described above by providing iron golf club heads and golf club sets, as well as methods of making and using the iron golf club heads and golf club sets. Generally described, an iron golf club head includes a cavity, a face portion for striking a golf ball, a heel portion, a toe portion, a top portion, and a sole portion. The iron golf club head can also include a groove within the sole portion extending between a front wall of the cavity and the rear-most portion of the sole portion of the golf club head. The iron golf club head can further include a raised section disposed within the groove. The raised portion can be formed from a material that is different than the material from which the remainder of the iron golf club head is formed. The iron golf club head can also include a weight disposed on at least a portion of the front wall of the cavity that extends upward from the sole portion.

The groove can be set at an oblique angle from the face portion so that it is parallel to the weight disposed within the cavity. The groove allows a greater amount of the overall weight of the iron golf club head to be distributed to the rear-most portion of the sole portion of the golf club head, thereby moving the center of mass depth farther away from the face portion, and thus increasing the effective dynamic loft of the iron golf club head. The groove can also lengthen the effective face length of the iron golf club head. Here, the effective face length refers to a length of a portion of the face portion that can flex when striking a golf ball and is defined to be a length in the direction from the sole portion toward the top portion of the iron golf club. Finally, the groove can serve to reduce the overall weight of the iron golf club head.

Other embodiments of the present invention are directed to sets of iron golf clubs. These sets can include at least one long iron golf club, at least one middle iron golf club, and at least one short iron golf club. Each of the at least one long iron golf club, at least one middle iron golf club, and at least one short iron golf club within the set can have a head that includes a cavity, a face portion, a heel portion, a toe portion, a top portion, and a sole portion. Each head of the golf clubs within the set can also include a weight disposed on at least a portion of the front wall of the cavity that extends upward from the sole portion. The heads of the at least one long iron golf club and the at least one middle iron golf club within the set can also have a groove within the sole portion extending between the front wall of the cavity and the rear-most portion of the sole portion of the iron golf club head. Each of these heads can further include a raised section disposed within the groove.

In some embodiments, the heads of the at least one short iron golf club within the set can also have a groove within the sole portion extending between the front wall of the cavity and the rear-most portion of the sole portion of the iron golf club head. In these embodiments, the short iron golf club heads can further include a raised section disposed within the groove.

The width and depth of the groove can vary between each long iron golf club, middle iron golf club, and short iron golf club, such that the width and/or depth of the groove of each long iron is greater than the width and/or depth of the groove of each middle iron, and the width and/or depth of the groove in each middle iron is greater than the width and/or depth of the groove of each short iron.

Other aspects and features of embodiments of the present invention will become apparent to those of ordinary skill in the art, upon reviewing the following detailed description in conjunction with the accompanying figures.

DETAILED DESCRIPTION OF EXEMPLARY & ALTERNATIVE EMBODIMENTS

Figure 1:
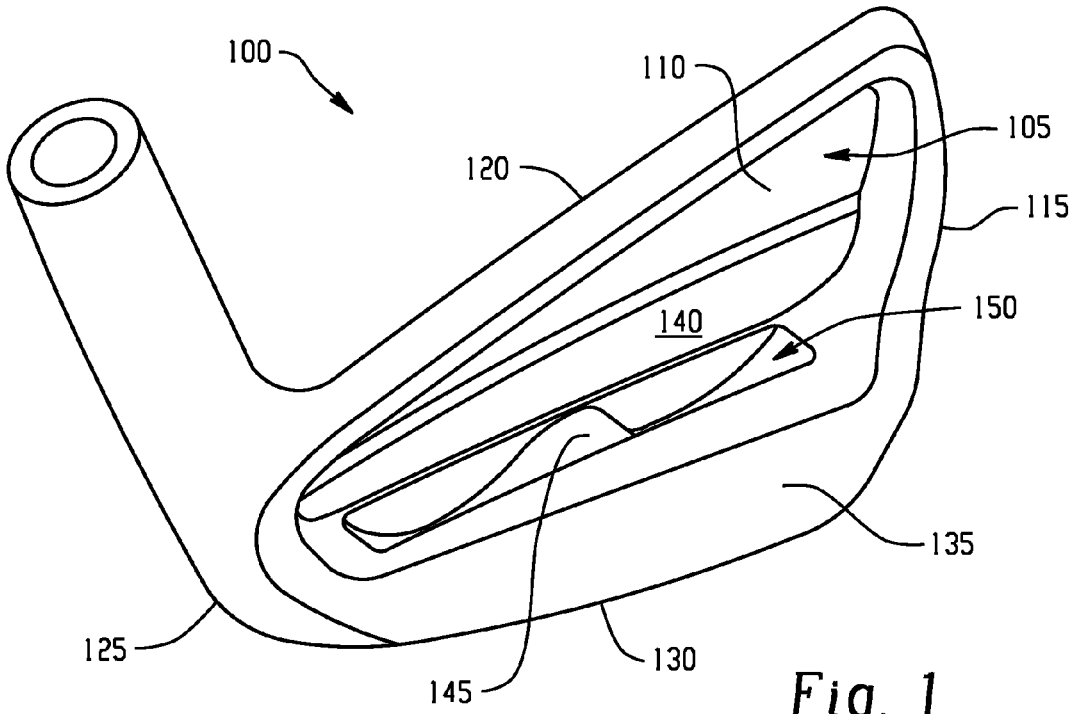
FIG. 1 is an illustration of a bird's eye view of an iron golf club head in accordance with some embodiments of the present invention.

Referring now to the figures, wherein like reference numerals represent like parts throughout the several views, exemplary embodiments of the present invention will be described in detail. Throughout this description, various components may be identified having specific values or parameters, however, these items are provided as exemplary embodiments. Indeed, the exemplary embodiments do not limit the various aspects and concepts of the present invention as many comparable parameters, sizes, ranges, and/or values may be implemented. The terms "first," "second," and the like, "primary," "secondary," and the like, and "top," "bottom," and the like do not denote any order, quantity, or importance, but rather are used to distinguish one element from another. Further, the terms "a", "an", and "the" do not denote a limitation of quantity, but rather denote the presence of "at least one" of the referenced item.

FIG. 1 is a diagram illustrating a bird's eye view of an iron golf club head 100 in accordance with some embodiments of the present invention. The iron golf club head 100 includes a cavity 105, which contains a front wall 110 and is surrounded by a toe portion 115, a top portion 120, a heel portion 125 and a sole portion 130. The iron golf club head 100 also includes a face portion (not shown), which is used for striking a golf ball.

The front wall 110 of the cavity 105 can include a weight 140 disposed thereon, which can be positioned toward the sole portion 130 within the cavity 105. The weight 140 can have a specific length, which is less than or equal to the length of the cavity 105, and may extend along an axis projecting from the toe portion 115 to the heel portion 125. For example, in some embodiments, the length of the weight 140 can be approximately 60 millimeters. The weight 140 is generally positioned directly behind the ball-hitting portion of the face portion to provide a high coefficient of restitution (COR), which is typically greater than 0.8. This concentration of mass increases the so-called "sweet spot" on the face portion, thereby improving the "feel" of the golf club for the average golfer. The weight 140 can adopt a variety of geometric shapes, including semi-circular (as seen in FIG. 1), trapezoidal, rectangular, triangular, circular, or the like.

In some instances, it is desirable to have the thickness of the weight 140 be tapered along its length from the toe portion 115 to the heel portion 125, such that the weight 140 increases in thickness at it progresses from the heel portion 125 towards the toe portion 115. By way of example, the thickness of the tapered weight 140 can be approximately three (3) millimeters toward the toe portion 115, while it can be approximately one (1) to two (2) millimeters toward the heel portion 125. The taper allows more mass to be placed toward the toe portion 115 of the iron golf club head 100. This feature (i.e., the additional mass towards the toe portion 115) allows for "off-center" hits toward the toe of the face portion to feel more solid.

The iron golf club head 100 further contains a groove 150 within the sole portion 130 running between the front wall 110 of the cavity 105 and the rear-most (i.e., away from the face portion, which is used to strike the golf ball) portion 135 of the sole portion 130. The groove 150 extends in a direction from the toe portion 115 towards the heel portion 125 and may be set at an oblique angle relative to the front wall 110 of the cavity 105. The groove 150 may be positioned such that the end of the groove 150 that is proximate to the toe portion 115 is located farther away from the front wall 110 of the cavity 105 than the end of the groove 150 proximate to the heel portion 125. In exemplary embodiments, the groove 150 is angled such that it is oriented parallel to the weight 140. By orienting the groove 150 parallel to the weight 140, particularly when the weight 140 is tapered, more weight may be placed toward the toe portion 115 to further provide a solid feel on off-center hits that occur towards the toe portion 115 of the face portion.

The iron golf club head 100 further includes a raised portion 145 disposed within the groove 150. The raised portion 145 can be located anywhere along the length of the groove 150. In exemplary embodiments, the raised portion 145 is placed in the center of the groove 150, such as is shown in FIG. 1. The raised portion 145 can serve to reinforce the groove 150, while minimizing unwanted vibrations that can occur from striking a golf ball. The combination of the raised portion 145 and the groove 150 allow for a lower and much deeper COG, which effectively increases the loft of the iron golf club head.

The raised portion 145 can be formed from the same material or a different material than the rest of the iron golf club head 100. Regardless of the material from which the raised portion 145 is formed, it can also be in the form of a separate piece that is added (either permanently or in a mechanically disengageable fashion) within the groove 150 after the other portions of the iron golf club head 100 have been fabricated. In some embodiments, the raised portion 145 can be formed from a material having a different density than the rest of the iron golf club head 100. By way of example, the raised portion 145 can be made from titanium and have a lower density than the composition from which the rest of the iron golf club head 100 (e.g. a steel alloy) is made. This will provide a softer feel to the club head 100. In other embodiments, the raised portion 145 can be formed from a material having a different elastic modulus than the rest of the iron golf club head 100. For example, if the raised portion 145 is made from a material having a higher elastic modulus than that of the rest of the iron golf club head 100, the club head 100 can exhibit a so-called "trampoline" or rebound effect. The trampoline effect can provide enhanced power and, therefore, distance for a given swing speed and contact point.

The groove 150 along with the raised portion 145 disposed therein has a width, which can be uniform or varied along the direction from the toe portion 115 to the heel portion 125. Generally, the width of the groove 150 is in the range of approximately eight (8) and fourteen (14) millimeters. The width of the raised portion 145 itself can be less than or equal to the width of the groove 150. In exemplary embodiments, the width of the raised portion 145 is identical to the width of the groove 150.

As the width of the groove 150 increases, more of the iron golf club head's weight can be redistributed farther back from the cavity 105. Thus, as more weight is moved rearward away from the cavity 105, the center of gravity depth of the iron golf club 100 is increased, which in turn increases the effective loft of the iron golf club head 100.

Figure 2:
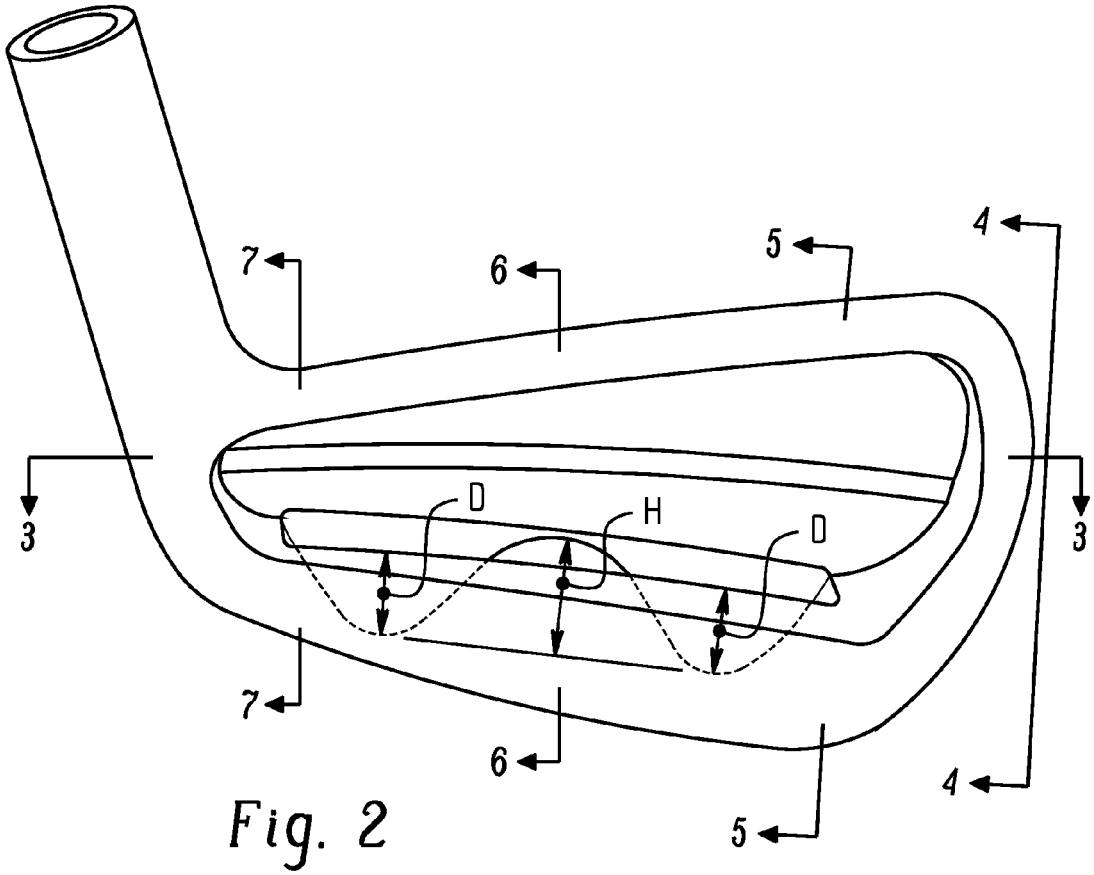
FIG. 2 is an illustration of a long iron golf club head viewed from the rear in accordance with some embodiments of the present invention.

As shown in FIG. 2, the groove 150 and the raised portion 145 have a depth, D, and a height, H, respectively. When the top of the raised portion 145 is co-planar with the top of the groove 150, the height of the raised portion 145 is equal to the depth of the groove 150. Otherwise, the height of the raised portion 145 will be less than or greater than the depth of the groove 150. In exemplary embodiments, the height of the raised portion 145 is less than or equal to the depth of the groove 150. And in some embodiments (and although not illustrated) the height of the raised portion 145 can be greater than the depth of the groove 150. The depth of the groove 150 may change in the direction from the toe portion 115 to the heel portion 125. The height of the raised portion 145 will have a corresponding change in the direction from the toe portion 115 to the heel portion 125.

For example, as shown in FIG. 2, the groove 150 begins at the toe portion 115 at the 5-5 line and gradually increases in depth until it reaches the midpoint between the 5-5 line and the 6-6 line, and then gradually decreases in depth until it reaches the 6-6 line, where the raised portion 145 has its maximum height. The depth of the groove then gradually increases again until it reaches the midpoint between the 6-6 line and the 7-7 line, and then gradually decreases in depth until it reaches the heel portion 125.

The presence of the raised portion 145 effectively creates two valleys within the overall groove 150. These two valleys can have the same or different depths, depending on the desired attributes of the iron golf club head 100. Generally, the groove 150 will have a maximum depth in the range of approximately three to approximately fifteen millimeters. In exemplary embodiments, the maximum depth of the groove 150 is about 8.5 millimeters. The varying depth of the groove 150 and the varying height of the raised portion 145 for a long iron golf club is shown in FIGS. 4-7, which respectively show the cross-sectional views taken along the 4-4 line, the 5-5 line, the 6-6 line, and the 7-7 line of the iron golf club head 100 shown in FIG. 2. By providing the groove 150 with the raised portion 145 disposed therein, as described above, the effective length of the face portion may be lengthened to make the face portion more flexible, thereby increasing the coefficient of restitution property of the face portion.

While the contour of the surface of the groove 150 with the raised portion 145 disposed therein shown in FIGS. 2 through 7 is sinusoidal, those skilled in the art will appreciate that the raised portion 145 can adopt a shapes other than a Gaussian curve (in cross-section), thereby changing the contour of the surface of the groove 150 with the raised portion 145 disposed therein. For example, the raised portion 145 may have a cross-sectional shape in the form of a triangle, square, rectangle, cone, circle, semi-circle, Lorentzian curve, Voigt curve, pseudo-Voigt curve, any of the foregoing having a frustum, and the like without departing from the scope of the invention.

The groove 150 and the raised portion 145 disposed therein may be formed by milling (cutting) a top surface of the sole portion using an appropriate milling tool. Once the location of the raised portion 145 is determined, the surrounding portions can be milled to form the desired depth profile of the groove 150. The location of the raised portion 145 can be milled to alter the height profile of the raised portion 145 as desired. According to some embodiments, the milling tool is set at an angle so as to make the groove 150 parallel to both the weight 140 and the face portion. The depth of the groove 150 may be varied between anywhere between zero (0) and nine (9) millimeters by selecting the appropriate size milling bits. In some instances, it may be necessary to mill the groove 150 in two stages: a rough milling stage, in which the majority of the material is removed and a fine milling stage, in which the groove 150 is cut to its final width and smoothed. These two stages can be performed on each side of the selected location of the raised portion 145.

Alternatively, as alluded to above, the raised portion 145 can be disposed within the groove 150 after the other components of the of the iron golf club head 100 have been fabricated. In these situations, the groove 150 can be formed by milling without regard to the location of the raised portion 145.

Additionally, the iron golf club head 100 may be used to create a golf club set, which includes at least one long iron golf club 200 (e.g., No. 1 through No. 5 iron golf clubs) shown in FIGS. 3 through 7, at least one middle iron golf club 800 (e.g., No. 6 and No. 7 iron golf club heads) shown in FIGS. 8 through 12, and at least one short iron golf club (e.g., No. 8, No. 9, a pitching wedge, sand wedge, gap wedge, lob wedge or like iron golf club heads) (not shown). Each of the at least one long iron golf clubs, the middle iron golf clubs and the short iron golf clubs can include a golf club head 100 that includes a cavity 105, which contains a front wall 110 and is surrounded by a toe portion 115, a top portion 120, a heel portion 125 and a sole portion 130. The heads 100 of these golf clubs also include a face portion (not shown), which is used for striking a golf ball. Each of the heads 100 of the at least one long iron golf club, middle iron golf club, and short iron golf club can also have a weight 140 generally positioned directly behind the ball-hitting portion of the face portion.

Each of the heads of the at least one long iron golf club 200, middle iron golf club 800, and/or short iron golf club (not shown) can also have a groove 150 with a raised portion 145 disposed therein. The width and/or depth of the groove 150 may vary between the long iron golf clubs, the middle iron golf clubs, and the short iron golf clubs. For example, the width and/or depth of the groove 150 may decrease from the long irons to the middle irons, and from the middle irons to the short irons within the golf club set. In exemplary embodiments, only the heads 100 of the at least one long iron golf club and at least one middle iron golf club have a groove 150 with a raised portion 145 disposed therein.

Figure 3:
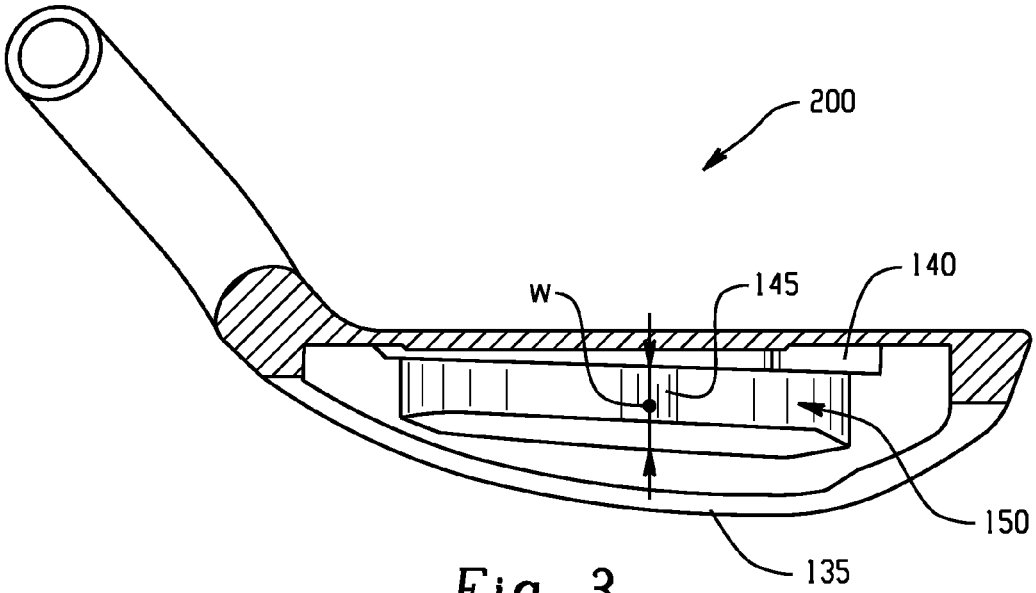
FIG. 3 is an illustration of a long iron golf club viewed along the 3-3 line of FIG. 2 in accordance with some embodiments of the present invention.
Figure 4:
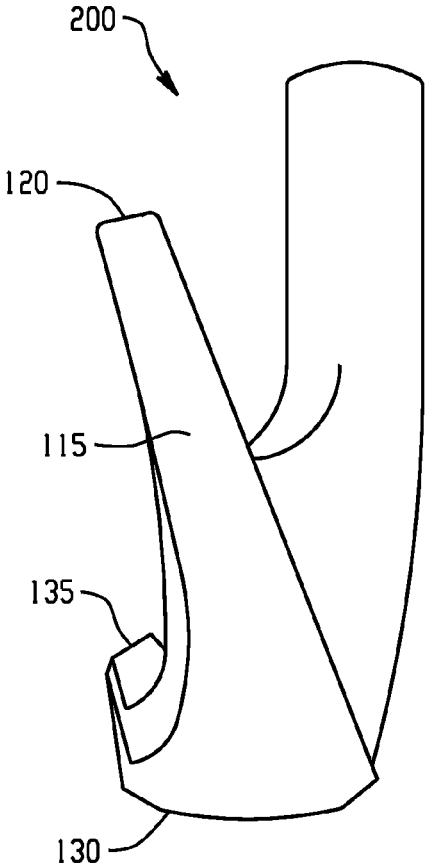
FIG. 4 is an illustration of a long iron golf club viewed along the 4-4 line of FIG. 2 in accordance with some embodiments of the present invention.
Figure 5:
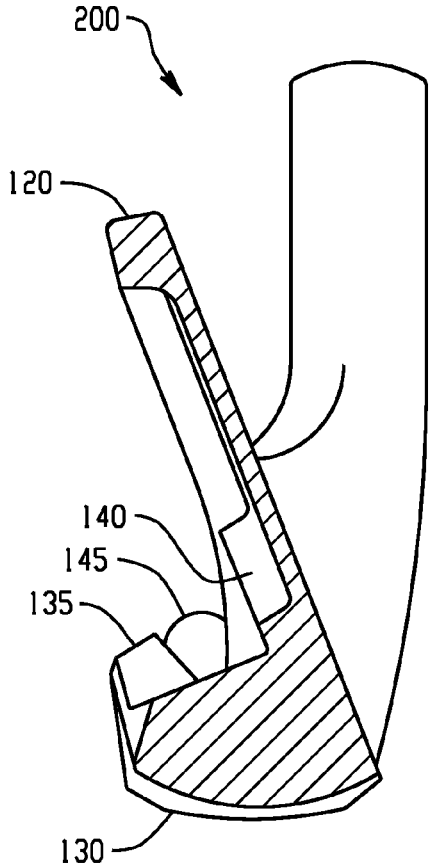
FIG. 5 is an illustration of a long iron golf club viewed along the 5-5 line of FIG. 2 in accordance some embodiments of the present invention.
Figure 6:
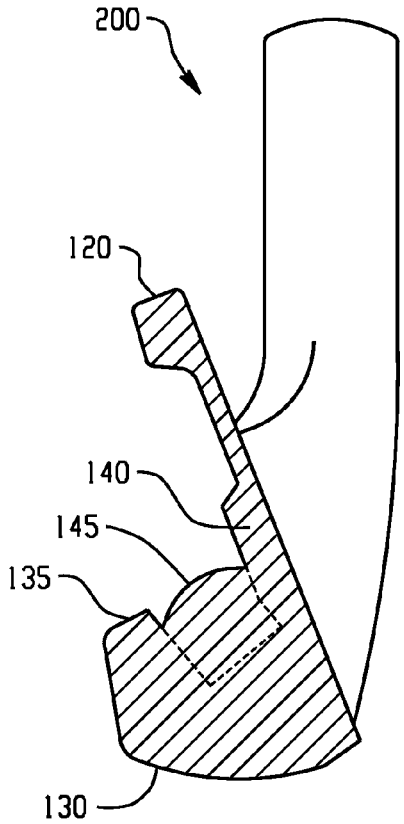
FIG. 6 is an illustration of a long iron golf club viewed along the 6-6 line of FIG. 2 in accordance with some embodiments of the present invention.
Figure 7:
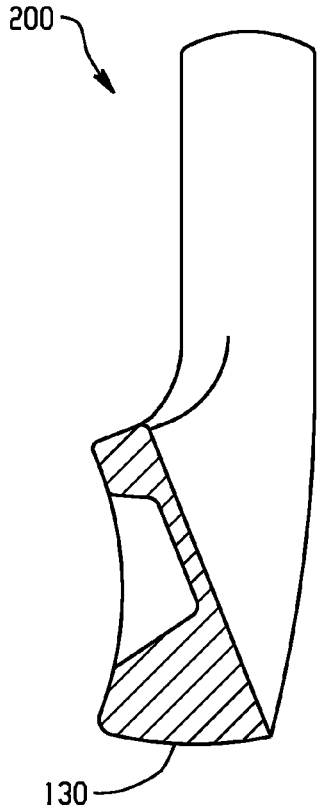
FIG. 7 is an illustration of a long iron golf club viewed along the 7-7 line of FIG. 2 in accordance with some embodiments of the present invention.

FIG. 3 illustrates a cross-section view of a long iron for the iron golf club head 200 taken along the 3-3 line in FIG. 2. The groove 150 for the long iron golf clubs (e.g., the No. 1 through the No. 5 irons) is set at an oblique angle from the face portion and is generally parallel to the weight 140. In some embodiments, the groove 150 may have a width in the range of approximately seven to approximately nine millimeters or between about three to about fifteen millimeters. The width of the raised portion 145 can be less than or equal to the width of the groove 150. FIGS. 4 through 7 show the cross-sectional views taken along the 4-4 line, the 5-5 line, the 6-6 line, and the 7-7 line of a long iron.

Figure 8:
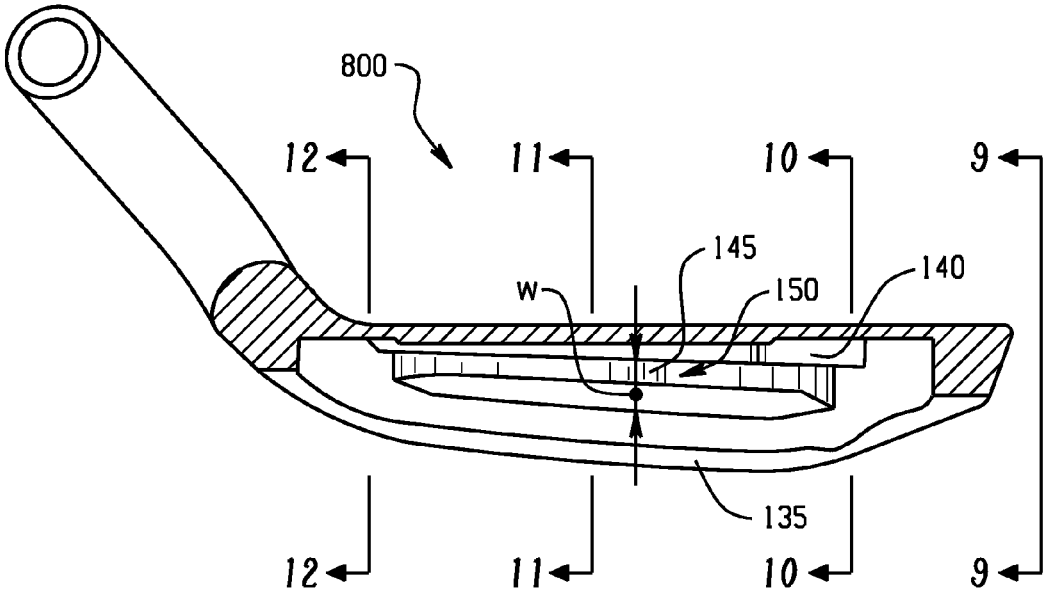
FIG. 8 is an illustration of a middle iron golf club viewed along the 3-3 line of FIG. 2 in accordance with some embodiments of the present invention.
Figure 12:
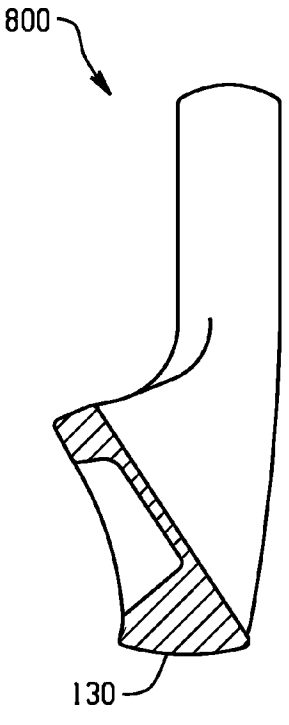
FIG. 12 is an illustration of a middle iron golf club viewed along the 12-12 line of FIG. 8 in accordance with some embodiments of the present invention.
Figure 11:
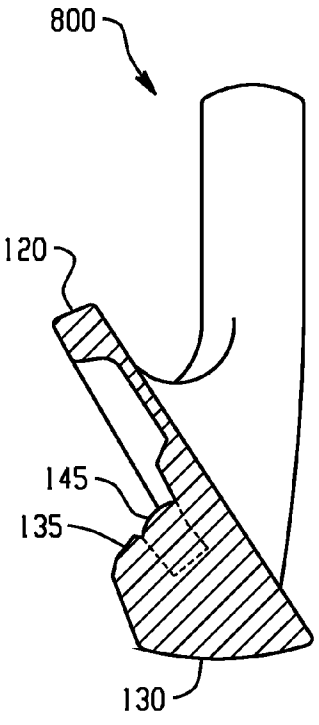
FIG. 11 is an illustration of a middle iron golf club viewed along the 11-11 line of FIG. 8 in accordance with some embodiments of the present invention.
Figure 10:
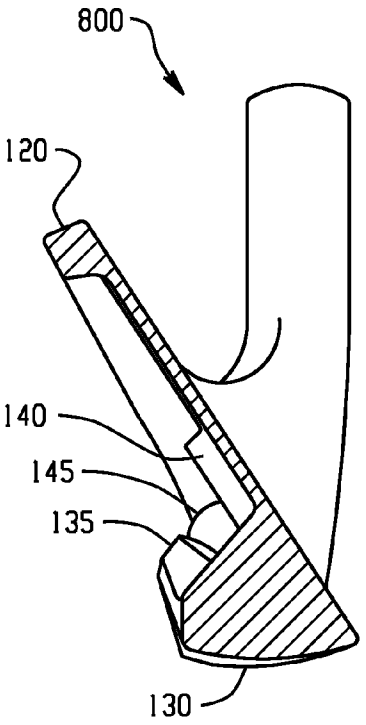
FIG. 10 is an illustration of a middle iron golf club viewed along the 10-10 line of FIG. 8 in accordance with some embodiments of the present invention.
Figure 9:
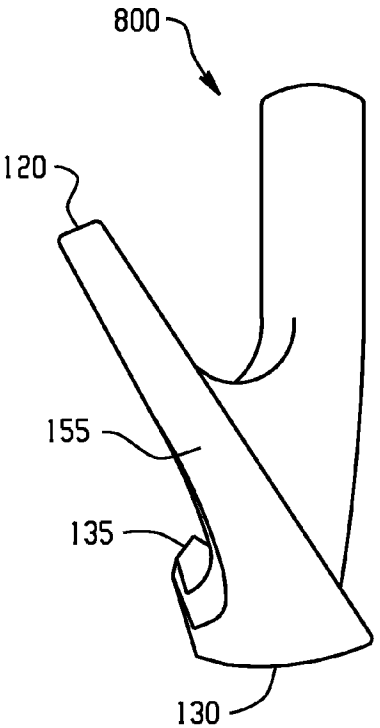
FIG. 9 is an illustration of a middle iron golf club viewed along the 9-9 line of FIG. 8 in accordance with some embodiments of the present invention.

In certain embodiments, the groove 150 of the middle irons (e.g., the No. 6 and No. 7 irons) can have a width in the range of approximately five (5) to approximately (7) millimeters. As with the long irons, the width of the raised portion 145 in the groove 150 of the middle irons, can be less than or equal to the width of the groove 150. FIG. 8 illustrates a cross-sectional view of a middle iron for the iron golf club head 800 taken along the 3-3 line in FIG. 2. FIGS. 9 through 12 show the cross-sectional views taken along the 9-9 line, the 10-10 line, the 11-11 line, and the 12-12 line of FIG. 8.

Finally, in embodiments where the iron golf club head of a short iron has a groove 150, it can be approximately one (1) to approximately five (5) millimeters. As with the long irons and middle irons, the width of the raised portion 145 in the groove 150 of the short irons, can be less than or equal to the width of the groove 150.

The orientation of the groove 150, along with the raised portion 145 disposed therein, provides improved playability characteristics. In but one example, increases in the COG depth of greater than or equal to approximately 20 percent can be observed in long, middle, or short iron golf clubs having a groove 150 and raised portion 145 disposed therein, as disclosed herein.

The embodiments of the present invention are not limited to the particular dimensions and materials disclosed herein as such dimensions and materials may vary somewhat. Moreover, the terminology employed herein is used for the purpose of describing exemplary embodiments only and the terminology is not intended to be limiting since the scope of the various embodiments of the present invention will be limited only by the appended claims and equivalents thereof.

We claim:

1. An iron golf club head having a cavity, a face portion, a heel portion, a toe portion, a top portion, and a sole portion, the iron golf club head comprising:

a groove extending between a front wall of the cavity and a rear most portion of the sole portion, the groove comprising opposing sidewalls that extend between the heel portion and the toe portion and defining a rimmed edge that surrounds the groove; and a raised portion disposed within the groove and between the opposing sidewalls, the raised portion being built into the groove as part of the club head, wherein the raised portion is sized and shaped to fit within the groove and comprises sidewall portions that extend between the opposing sidewalls of the groove, and wherein the raised portion comprises at least one portion that extends between a bottom surface of the groove and the rimmed edge of the groove, and wherein a cross section of the raised portion defines a continuous smooth wave within the groove, the wave defining at least one peak and two valleys, and the wave extending continuously between opposing edges of the groove.

2. The iron golf club head of claim 1, further comprising a weight disposed on at least a portion of the front wall of the cavity and extending upward from the sole portion.

3. The iron golf club head of claim 2, wherein the groove with the raised portion disposed therein is oriented parallel to the weight.

4. The iron golf club head of claim 2, wherein the weight has a thickness that is tapered from the toe portion to the heel portion.

5. The iron golf club head of claim 2, wherein the weight has a length along an axis extending from the heel portion to the toe portion that is less than the length of the cavity.

6. The iron golf club head of claim 1, wherein the groove is offset from the face portion at an oblique angle.

7. The iron golf club head of claim 1, wherein the groove has a width of less than or equal to approximately 14 millimeters.

8. The iron golf club head of claim 1, wherein the groove has a depth of approximately 3 millimeters to approximately 15 millimeters.

9. The iron golf club head of claim 1, wherein the raised portion has a height less than, equal to, or greater than the depth of the groove.

10. The iron golf club head of claim 1, wherein the raised portion is disposed in the center of the groove.

11. The iron golf club head of claim 1, wherein the raised portion has a cross-sectional shape comprising a Gaussian curve, a Lorentzian curve, a Voigt curve, a pseudo-Voigt curve, a triangle, a square, a rectangle, a cone, a circle, a semi-circle, or any of the foregoing shapes having a frustum.

12. The iron golf club head of claim 1, wherein the raised portion is formed from a different material than a material from which a remainder of the iron golf club head is formed.

13. A golf club set, comprising:

at least one long iron golf club;

at least one middle iron golf club; and at least one short iron golf club;

wherein each of the at least one long iron golf club, at least one middle iron golf club, and at least one short iron golf club comprises a head;

wherein the head comprises a cavity, a face portion, a heel portion, a toe portion, a top portion, and a sole portion; and wherein the head additionally comprises:

a groove extending between a front wall of the cavity and a rear most portion of the sole portion, wherein the groove comprising opposing sidewalls that extend between the heel portion and the toe portion and defining a rimmed edge that surrounds the groove; and a raised portion sized and shaped to fit within the groove, the raised portion being built within the groove, the raised portion defining at least one peak and two valleys that define a continuous smooth wave that continuously extends between opposing edges of the groove.

14. The golf club set of claim 13, wherein the groove of each head has a width, such that the width of the groove of each long iron is greater than the width of the groove of each middle iron.

15. The golf club set of claim 13, wherein the groove of each head has a width, such that the width of the groove of each middle iron is greater than a width of the groove of each short iron.

16. The golf club set of claim 13, wherein each head further comprises a weight disposed on at least a portion of the front wall of the cavity and extending upward from the sole portion.

17. The golf club set of claim 16, wherein the groove with the raised portion disposed therein of each head is oriented parallel to the weight.

18. The golf club set of claim 16, wherein the weight of each head has a thickness that is tapered from the toe portion to the heel portion.

19. The golf club set of claim 16, wherein the weight of each head has a length along an axis extending from the heel portion to the toe portion that is less than the length of the cavity.

20. The golf club set of claim 13, wherein the groove of each head is offset from the face portion at an oblique angle.

21. The golf club set of claim 13, wherein the raised portion of each head has a height less than or equal to the depth of the groove.

22. The golf club set of claim 13, wherein the raised portion of each head is disposed in the center of the groove of each head.

23. The iron golf club head of claim 13, wherein the raised portion of each head has a cross-sectional shape comprising a Gaussian curve, a Lorentzian curve, a Voigt curve, a pseudo-Voigt curve, a triangle, a square, a rectangle, a cone, a circle, a semi-circle, or any of the foregoing shapes having a frustum.

24. A golf club set, comprising:

at least one long iron golf club;

at least one middle iron golf club; and at least one short iron golf club;

wherein each of the at least one long iron golf club, at least one middle iron golf club, and at least one short iron golf club comprises a head;

wherein the head comprises a cavity, a face portion, a heel portion, a toe portion, a top portion, and a sole portion; and wherein the head additionally comprises:

a groove extending between a front wall of the cavity and a rear most portion of the sole portion; and a raised portion disposed within the groove, a cross section of the raised portion defining a smooth sinusoidal curve within the groove, the sinusoidal curve defining at least one peak and two valleys, and the sinusoidal curve extending continuously between opposing edges of the groove, wherein the raised portion of each head is formed from a different material than a material from which a remainder of the iron golf club head is formed.

* * * * *